US012140144B2

(12) United States Patent
Kolyshkin et al.

(10) Patent No.: US 12,140,144 B2
(45) **Date of Patent: *Nov. 12, 2024**

(54) MUD MOTOR ROTOR WITH CORE AND SHELL

(71) Applicant: Schlumberger Technology Corporation, Sugar Land, TX (US)

(72) Inventors: Anton Kolyshkin, Cambridge (GB); Li Guo, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/474,768

(22) Filed: Sep. 26, 2023

(65) Prior Publication Data

US 2024/0026880 A1 Jan. 25, 2024

Related U.S. Application Data

(62) Division of application No. 17/192,044, filed on Mar. 4, 2021, now Pat. No. 11,795,946.

(Continued)

(51) Int. Cl.

| | |
|---|---|
| ***F01C 1/10*** | (2006.01) |
| ***E21B 4/02*** | (2006.01) |
| ***F03C 2/00*** | (2006.01) |
| ***F03C 4/00*** | (2006.01) |
| ***F04C 2/08*** | (2006.01) |
| ***F04C 2/107*** | (2006.01) |
| ***F04C 18/00*** | (2006.01) |

(52) U.S. Cl.

CPC ..... *F04C 2/1071* (2013.01); *E21B 4/02* (2013.01); *F04C 2/084* (2013.01); *F04C 2/1076* (2013.01);

(Continued)

(58) Field of Classification Search

CPC ..... F04C 2/084; F04C 2/1071; F04C 2/1076; F04C 13/008; F04C 2230/21;

(Continued)

(56) References Cited

U.S. PATENT DOCUMENTS 4,187,061 A 2/1980 Jurgens
4,415,316 A 11/1983 Jurgens (Continued)

FOREIGN PATENT DOCUMENTS

DE 102019112790 A1 11/2020
JP 2004052655 A 2/2004

(Continued)

OTHER PUBLICATIONS

DE-102019112790-A1—Grosseschallau et al.—Rotor Shaft Assembly—Nov. 19, 2020—the English Machine Translation (Year: 2020).

*Primary Examiner* — Theresa Trieu
(74) *Attorney, Agent, or Firm* — Jeffrey D. Frantz

(57) ABSTRACT

A rotor for a mud motor includes a core having a first outer shape, and a shell positioned around the core, the shell having a second outer shape that is different from the first outer shape, the second outer shape defining one or more lobes and one or more cavities that are configured to engage a bore of a stator during rotation of the rotor relative to the stator. A thickness of the shell varies as proceeding around the core, from a non-zero minimum thickness to a maximum thickness.

7 Claims, 5 Drawing Sheets

Related U.S. Application Data

(60) Provisional application No. 62/985,135, filed on Mar. 4, 2020.

(52) U.S. Cl.
CPC ..... *F04C 2230/21* (2013.01); *F04C 2230/91* (2013.01); *F04C 2250/20* (2013.01); *Y10T 29/49242* (2015.01)

(58) Field of Classification Search
CPC ..... F04C 2230/91; F04C 2250/20; Y10T 29/49242; B23P 15/00; B23P 2700/00
See application file for complete search history.

(56) References Cited

U.S. PATENT DOCUMENTS

| | | | | |
|---|---|---|---|---|
| 5,165,881 | A | 11/1992 | Wicen | |
| 6,183,226 | B1 | 2/2001 | Wood et al. | |
| 6,461,128 | B2 | 10/2002 | Wood | |
| 7,909,591 | B2 | 3/2011 | Kachele | |
| 8,337,182 | B2 | 12/2012 | Lee et al. | |
| 8,444,901 | B2 | 5/2013 | Sindt | |
| 9,932,983 | B2 | 4/2018 | Eybergen et al. | |
| 10,508,492 | B2 | 12/2019 | Barnard | |
| 11,795,946 | B2 * | 10/2023 | Kolyshkin | F04C 2/1071 |
| 2009/0016893 | A1 | 1/2009 | Lee | |
| 2010/0038142 | A1 | 2/2010 | Snyder | |
| 2012/0102738 | A1 * | 5/2012 | Akbari | F04C 2/1071 29/888.023 |
| 2012/0134861 | A1 * | 5/2012 | Akbari | F04C 2/1071 418/48 |
| 2015/0122549 | A1 | 5/2015 | Hohl | |
| 2018/0003175 | A1 | 1/2018 | Pushkarev et al. | |
| 2018/0266181 | A1 | 9/2018 | Gawski et al. | |
| 2021/0277719 | A1 | 9/2021 | Kolyshkin | |

FOREIGN PATENT DOCUMENTS

| | | | |
|---|---|---|---|
| WO | 2007048555 | A1 | 5/2007 |
| WO | 2018222530 | A1 | 12/2018 |

* cited by examiner

MUD MOTOR ROTOR WITH CORE AND SHELL

CROSS-REFERENCE TO RELATED APPLICATION

This application is a divisional of U.S. patent application Ser. No. 17/192,044, filed Mar. 4, 2021, which claims the benefit of, and priority to, U.S. Patent Application No. 62/985,135 entitled "Mud Motor Rotor With Core And Shell" filed Mar. 4, 2020. Each of the above applications is incorporated herein by reference in its entirety.

BACKGROUND

Downhole or "mud" motors are used in drilling assemblies, e.g., in the oil and gas industry, to turn a drill bit at the end of a drill string, generate electricity, or otherwise produce rotation of a tool within the wellbore. The mud motors may be powered by flowing drilling fluid ("mud") through the drill string. The mud is also used to lubricate the drill string and to carry away cuttings in the annulus between the drill string and the wellbore wall. Thus, the mud may include particulate matter, potentially in addition to solvents and other liquids. As such, the mud provides a readily-available energy source to drive the downhole mud motor, but also presents a harsh working environment for the components of the mud motor.

One type of mud motor that has been used with success in this environment is a progressive cavity or Moineau-style motor. This type of mud motor generally includes a helical rotor received inside a bore of a stator. The stator bore generally has inwardly-extending, curved lobes alternating with outwardly-extending, curved cavities or "chambers". Pressure in the fluid drives the helical rotor to rotate within the bore of the stator. To accommodate the harsh environment, rotors may be made from relatively strong, corrosion-resistant metal alloys. For example, if the drilling mud is expected to include chloride, which is corrosive to steel alloys that include chromium, tungsten-carbide rotors may be employed. However, such materials may be expensive, making up a large portion of the total expense of the mud motor.

SUMMARY

A rotor for a mud motor is disclosed. The rotor includes a core having a first outer shape, and a shell positioned around the core, the shell having a second outer shape that is different from the first outer shape, the second outer shape defining one or more lobes and one or more cavities that are configured to engage a bore of a stator during rotation of the rotor relative to the stator. A thickness of the shell varies as proceeding around the core, from a non-zero minimum thickness to a maximum thickness.

A method for manufacturing a rotor for a mud motor is also disclosed. The method includes forming a shell around a core. The shell has a different outer shape than the core. The shell defines one or more lobes and one or more cavities, the one or more lobes and the one or more cavities being configured to engage a bore of a stator of the mud motor during rotation of the rotor with respect to the stator. A thickness of the shell varies as proceeding around the rotor, from a non-zero minimum thickness to a maximum thickness.

A method for manufacturing a mud motor is also disclosed. The method includes forming a core having a first outer shape, and forming a shell having a second outer shape around the core, the first outer shape being different from the second outer shape. The second outer shape includes one or more lobes and one or more cavities. The shell and the core at least partially form a rotor of the mud motor, and wherein a thickness of the shell varies as proceeding around the core, from a non-zero minimum thickness of at least about 1 mm to a maximum thickness that is greater than the minimum thickness and at most about 25% of a maximum cross-sectional dimension of the rotor. The method further includes positioning the rotor in a stator, such that the shell is configured to engage an inner bore of the stator during rotation of the rotor relative to the stator.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
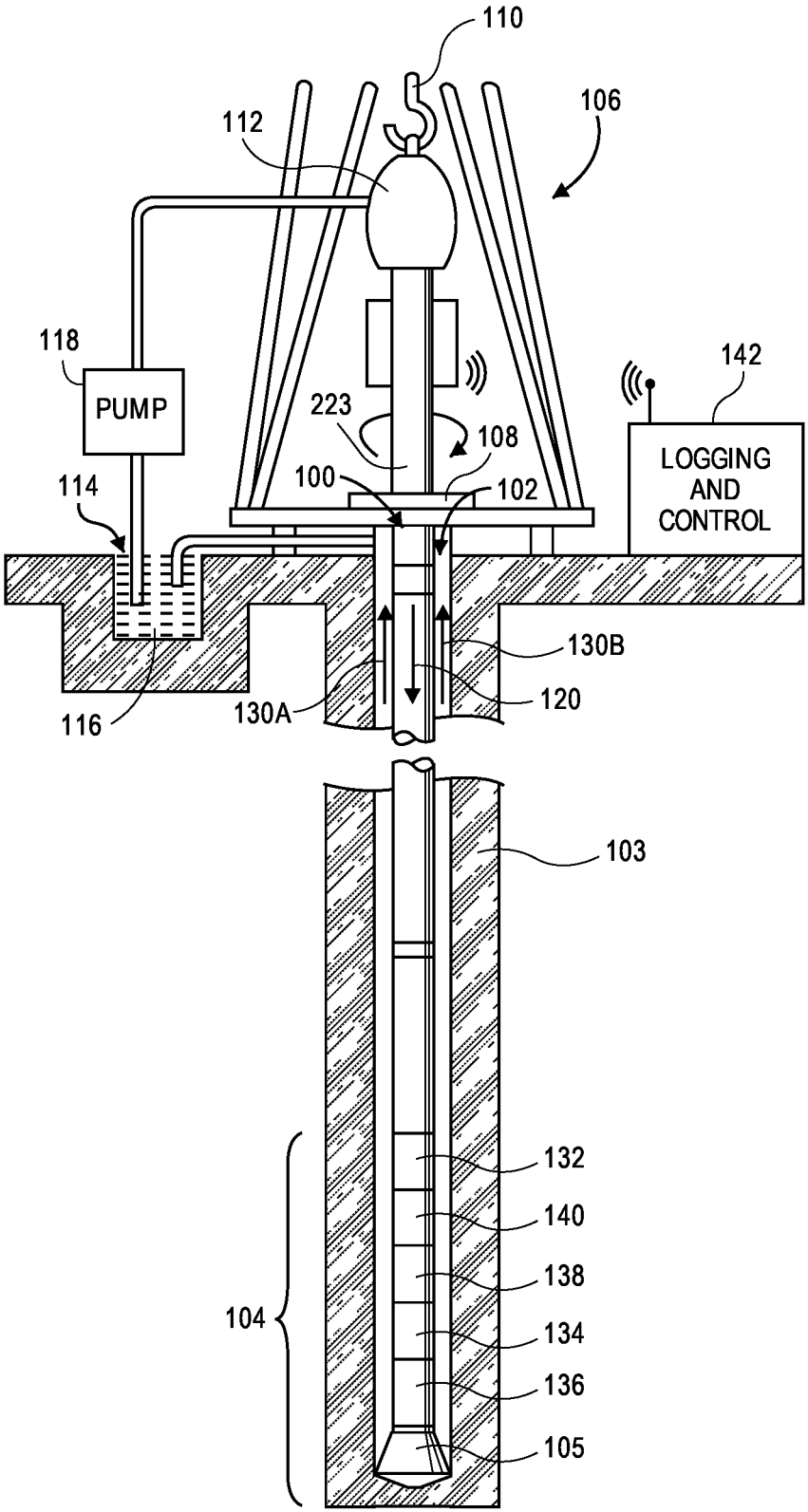
FIG. 1 illustrates an example of a wellsite system, according to an embodiment.

FIG. 1 illustrates a wellsite system according to examples of the present disclosure may be used. The wellsite can be onshore or offshore. In this example system, a drill string 100 is suspended in a bore 102 formed in subsurface formations 103. The drill string 100 has a bottom hole assembly (BHA) 104 which includes a drill bit 105 at its lower end. A surface system 106 includes platform and derrick assembly positioned over the borehole 102, the assembly including a rotary table 108, kelly (not shown), hook 110, and rotary swivel 112. The drill string 100 is rotated by the rotary table 108 energized by a driver 223, which engages the kelly (not shown) at the upper end of the drill string 100. The drill string 100 is suspended from the hook 110, attached to a traveling block (also not shown), through the kelly (not shown) and the rotary swivel 112 which permits rotation of the drill string 100 relative to the hook 110. A top drive system could be used instead of the rotary table system shown in FIG. 1.

In the illustrated example, the surface system 106 further includes drilling fluid or mud 114 stored in a pit 116 formed at the well site. A pump 118 delivers the drilling fluid to the interior of the drill string 100 via a port (not shown) in the swivel 112, causing the drilling fluid to flow downwardly through the drill string 100 as indicated by the directional arrow 120. The drilling fluid exits the drill string 100 via ports (not shown) in the drill bit 105, and then circulates upwardly through an annulus region between the outside of the drill string 100 and the wall of the borehole 102, as indicated by the directional arrows 130A and 130B. In this manner, the drilling fluid cools and lubricates the drill bit 105 and carries formation cuttings up to the surface as it is returned to the pit 116 for recirculation.

The BHA 104 of the illustrated embodiment may include a measuring-while-drilling (MWD) tool 132, a logging-while-drilling (LWD) tool 134, a rotary steerable directional drilling system 136 and motor, and the drill bit 105. It will also be understood that more than one LWD tool and/or MWD tool can be employed, e.g., as represented at 138.

The LWD tool 134 is housed in a drill collar and can contain one or a plurality of logging tools. The LWD tool 134 may include capabilities for measuring, processing, and storing information, as well as for communicating with the surface equipment. In the present example, the LWD tool 134 may include one or more tools configured to measure, without limitation, electrical resistivity, acoustic velocity or slowness, neutron porosity, gamma-gamma density, neutron activation spectroscopy, nuclear magnetic resonance and natural gamma emission spectroscopy.

The MWD tool 132 is also housed in a drill collar and can contain one or more devices for measuring characteristics of the drill string and drill bit. The MWD tool 132 further includes an apparatus 140 for generating electrical power for the downhole system. This may typically include a mud turbine generator powered by the flow of the drilling fluid, it being understood that other power and/or battery systems may be employed. In the present embodiment, the MWD tool 132 may include one or more of the following types of measuring devices, without limitation: a weight-on-bit measuring device, a torque measuring device, a vibration measuring device, a shock measuring device, a stick slip measuring device, a direction measuring device, and an inclination measuring device. The power generating apparatus 140 may also include a drilling fluid flow modulator for communicating measurement and/or tool condition signals to the surface for detection and interpretation by a logging and control unit 142. In some embodiments, the power generating apparatus 140 is configured to transfer energy (e.g., pressure) in the drilling fluid to rotational energy.

Figure 2:
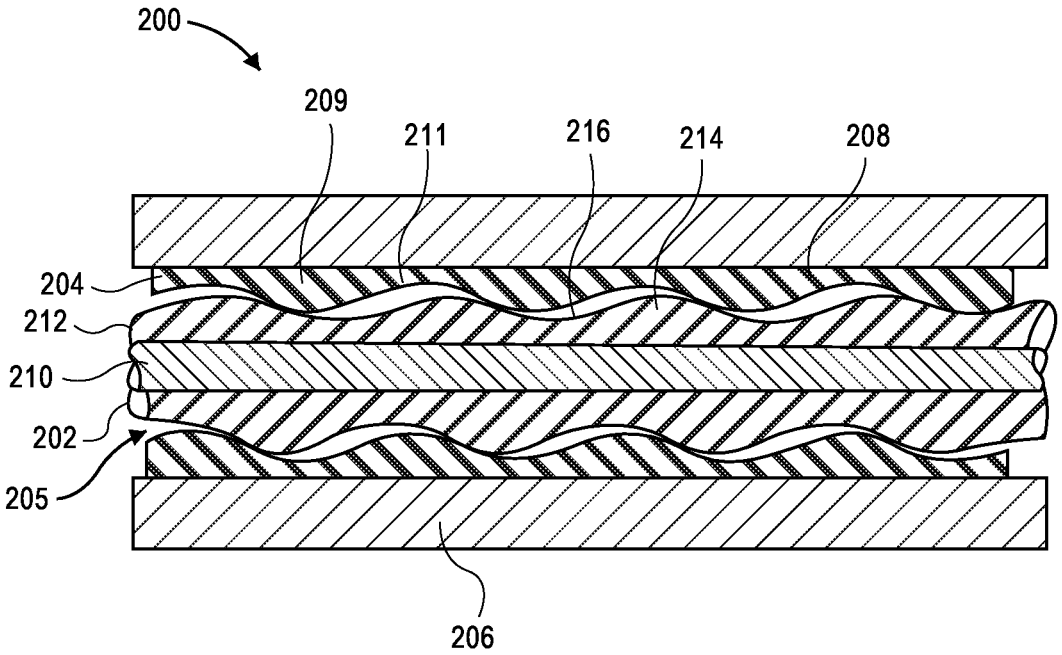
FIG. 2 illustrates a cross-sectional side view of a portion of a mud motor, according to an embodiment.

FIG. 2 illustrates a cross-sectional side view of a mud motor 200 (an example of the apparatus 140 of FIG. 1), according to an embodiment. As shown, the mud motor 200 may be a Moineau-style, progressive-cavity motor, and may thus include a helical rotor 202 and a corresponding stator 204. The stator 204 defines a bore 205, and the rotor 202 is received therein, as shown. The rotor 202/stator 204 combination may be housed in a tube 206, which may surround an outer surface 208 of the stator 204. As such, the outer surface 208 may interface (e.g., contact potentially via a layer of adhesive and/or one or more other layers) with the tube 206 when assembled therein. The stator 204 may also include inwardly-extending lobes 209 alternating with outwardly-extending cavities 211. The lobes 209 and cavities 211 may cooperatively define the bore 205.

The rotor 202 may not be monolithic, but may, for example, include at least two components, e.g., a central core 210 and a shell 212 that surrounds the core 210. Further, the shell 212 may define outwardly-extending lobes 214 alternating with inwardly-extending cavities 216. The lobes 214 and cavities 216 may interface with the lobes 209 and cavities 211 of the inner bore 205 of the stator 204, such that fluid (e.g., drilling mud) flowing through the bore 205 causes the rotor 202 to rotate relative to the stator 204, in accordance with principles of operation of a progressive cavity mud motor.

Figure 3:
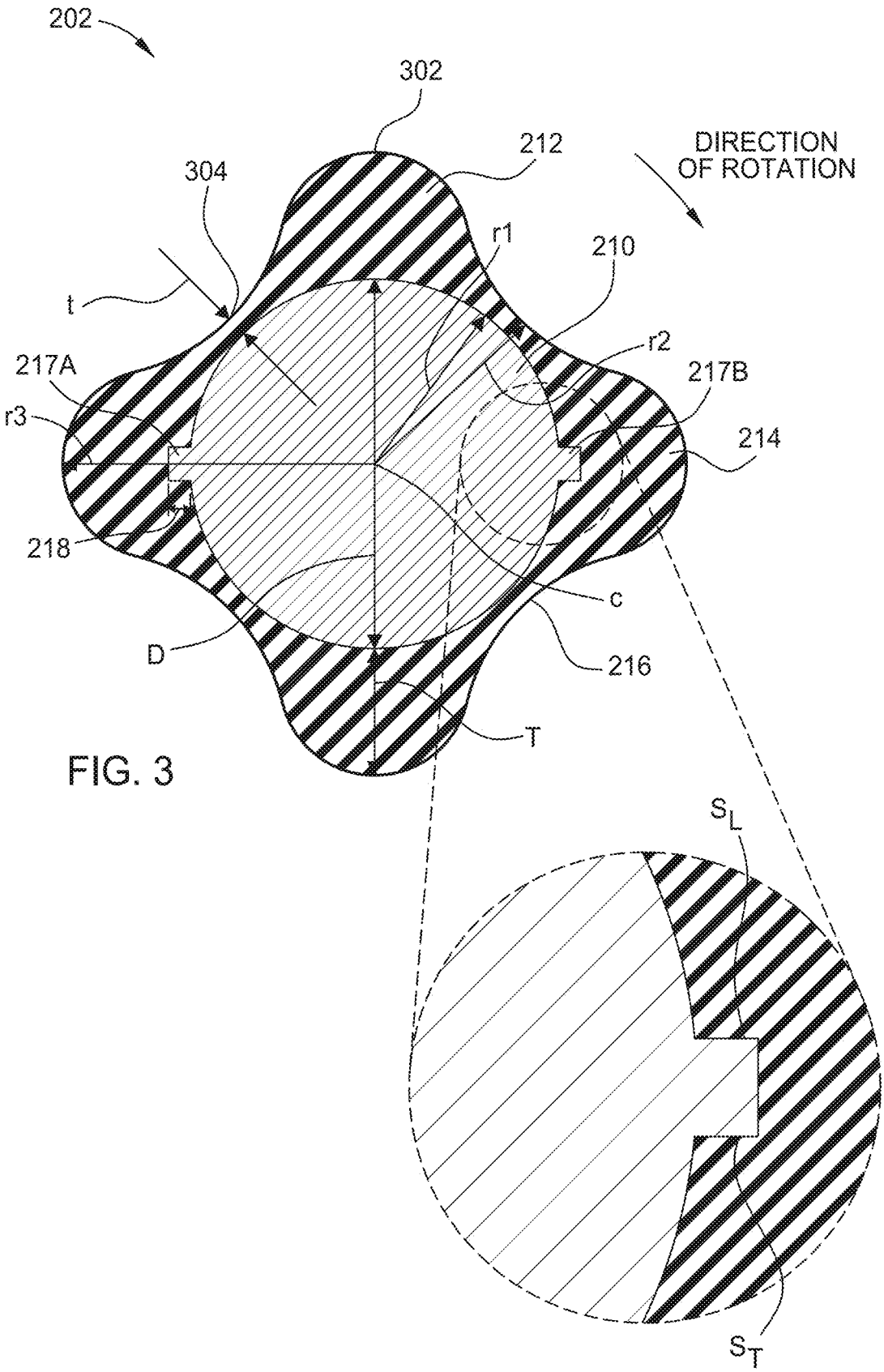
FIGS. 3, 3A, and 3B illustrate axial cross-sections of rotors of the mud motor, according to embodiments.
Figure 3A:
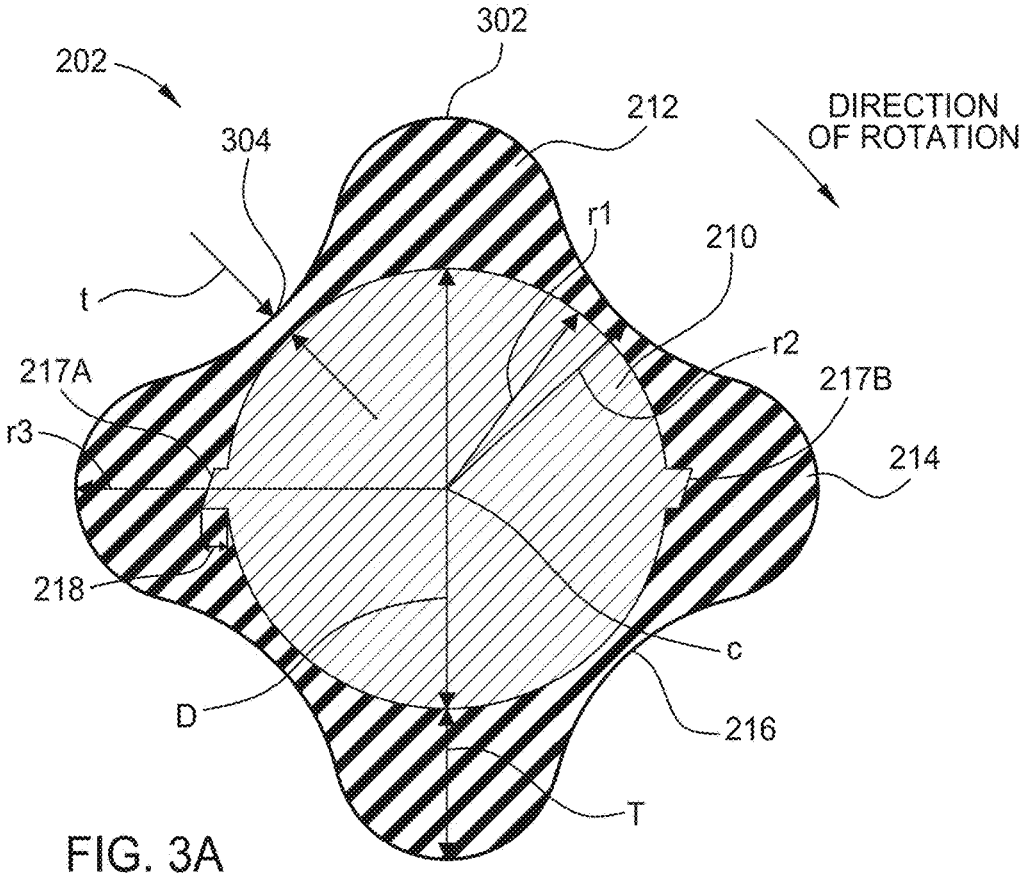
Figure 3B:
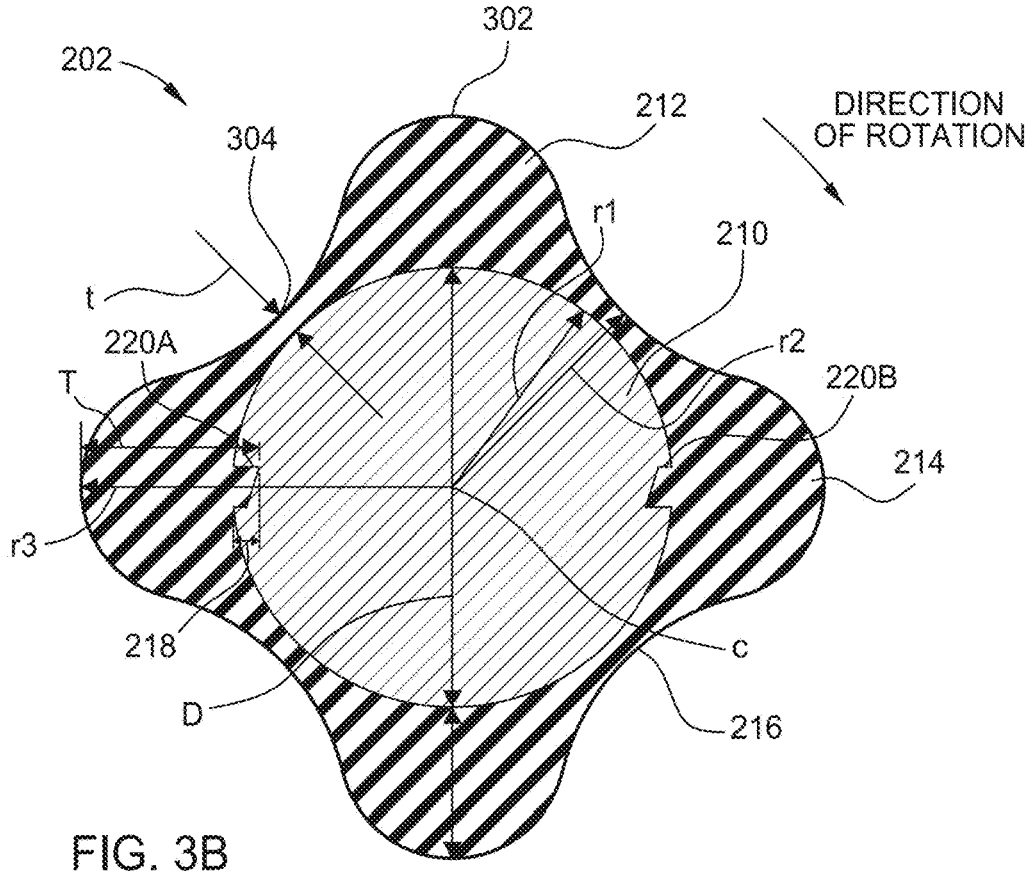

FIGS. 3, 3A, and 3B illustrate axial cross-sections of rotors of the mud motor, according to embodiments. As shown, the core 210 may have a first cross-sectional, outer shape. For example, the core 210 may be a cylindrical rod or shaft (as also depicted in FIG. 2), and thus may have the circular cross-sectional shape illustrated. In another embodiment, the core 210 may be helical. In other embodiments, the core 210 may be polygonal (e.g., square) in cross-section, or may have any other suitable shape. In some embodiments, the core 210 may be made from metal, e.g., a steel alloy. Some steel alloys are prone to corrosion in the downhole fluid environment. For example, steel alloys that include chromium may be subject to corrosion if allowed in contact with the downhole fluid, as the downhole fluid often includes chloride.

Thus, the shell 212 may be a positioned around and may fully encase the cross-section of the core 210. The shell 212 may be configured to engage the bore 205 of the stator 204. Accordingly, the shell 212 may be exposed to the downhole fluid environment, and may thus be formed from a material configured to survive this environment and, e.g., protect the core 210, while being cost-effective to produce. Further, the material may be configured to resist substantial softening or degradation that would impair operation of the rotor 202 in temperatures experienced in the downhole environment. Examples of temperatures in which the shell 212 may be configured to operate range from 110° C. to about 160° C., or higher. In some embodiments, the shell 212 is formed using a material that has a lower strength than the core 210, a lower melting point than the core 210, and/or a different coefficient of expansion than the core 210. Examples of materials that may be used for the shell 212 include carbon fiber-reinforced composites, thermoplastics such as nylon, other plastics, combinations thereof, and/or other materials. In some embodiments, a coating may be applied to the shell 212, so as to reduce friction between the shell 212 and the stator 204 and/or to protect the shell 212 from degradation in the downhole fluids.

Figure 4:
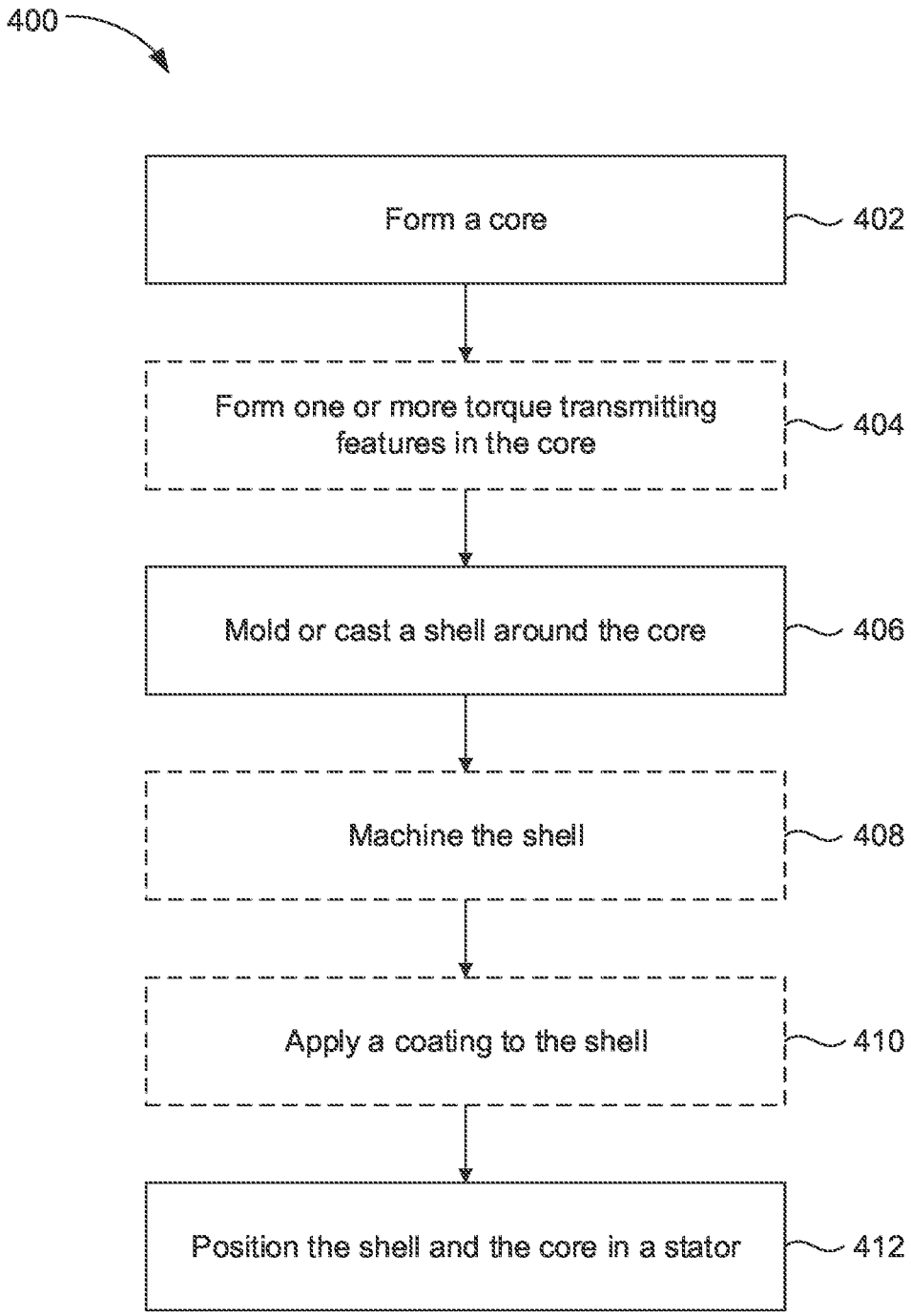
FIG. 4 illustrates a method for manufacturing a mud motor, according to an embodiment.

The shell 212 may extend outward from the core 210 and define a second outer shape that is different from the first outer shape of the core 210. This may be unlike a coating, for example, because a coating on a cylindrical core 210 may generally also define a cylindrical shape. As shown in FIG. 4, the shell 212 may define at least a portion of the lobes 214 and cavities 216, which are not apparent in the, e.g., cylindrical, core 210. Thus, not only does the shell 212, in some embodiments, prevent the underlying core 210 from exposure to the drilling fluid (thereby potentially preventing corrosion of the core 210), but the shell 212 may provide a geometry which may be more complex than the geometry of the core 210, e.g., including helical lobes 214 and cavities 216 versus, e.g., a cylindrical geometry for the core 210.

The shell 212 and the core 210 may each have a center, which may represent a line extending therethrough. In the illustrated embodiment, the shell 212 and the core 210 have the same center c. In some embodiments, the shell 212 and/or core 210 may each be generally symmetric about the centerline, although deviations from precise symmetry may occur due to tolerances in manufacturing, etc. In some embodiments, the center of the shell 212 may be different from the center of the core 210, e.g., such that the centers orbit one another when the rotor 202 rotates. Further, in still other embodiments, the shell 212 and/or the core 210 may not be symmetric about a centerline, but may be asymmetrically shaped.

In an embodiment, the shell 212 may vary in radial thickness as proceeding circumferentially around the center c, e.g., around the core 210. For example, the shell 212 may have a maximum thickness T and a non-zero minimum thickness t, and may vary therebetween. In the illustrated embodiment, in which the core 210 is cylindrical, the maximum thickness T may be located at a peak 302 of the lobe 214, while the minimum thickness t may be located a trough 304 of the cavity 216. Further, in this embodiment, the shell 212 may define a continuous curved surface that defines thicknesses smoothly transitioning between the maximum thickness T and the minimum thickness t.

The minimum thickness t may be configured to be sufficient for the shell 212 to survive in operation, and thus the specific dimension thereof may depend on the properties of the particular material chosen for the shell 212. The minimum thickness t may, however, be thicker than most or all coatings. For example, the minimum thickness t may be about 1 mm, about 2 mm, between about 1 mm and about 10 mm, between about 2 mm and about 5 mm, or any other suitable range. The maximum thickness T may vary depending, e.g., on the application for the rotor 202, as different mud motor applications may call for differently-sized rotors 202. In general, however, the maximum thickness T may be between about 10% and about 50%, between about 15% and about 40%, or between about 20% and about 30% of the maximum cross-sectional dimension (e.g., diameter D) of the core 210.

In other embodiments, the core 210 may be non-cylindrical, which may make the geometry of the shell 212 more complex. The core 210 may define a radial line r1 between its center (in this case, center c) and its outer surface. Since the core 210 in the illustrated embodiment is cylindrical, the radial line r1 is its radius, and may be remain roughly constant (e.g., within reasonable tolerances) as proceeding 360 degrees around the center c. In other embodiments, the radial line r1 may vary in length depending on its angular orientation. For example, the core 210 may have helical lobes, and the peaks of lobes of the core 210 may rotationally lag the peaks of the shell 212, thereby providing circumferential support for the shell 212.

The shell 212 may also define one or more radial lines, e.g., radial lines r2 and r3. For example, the radial line r2 may extend from the center of the shell 212 (e.g., the center c) to the trough 304 of the cavity 216. The radial line r3 may extend from the center c to the peak 302 of the lobe 214. Accordingly, the length of the radial line r2 may be the shortest distance between the outer surface of the rotor 202 and the center c, and the length of the radial line r3 may be the longest distance between the outer surface of the rotor 202 and the center c. However, the position of the radial line r2 may or may not coincide with the location of the minimum thickness t and/or the radial line r3 may or may not coincide with the location of the maximum thickness T. In an embodiment in which the core 210 is non-cylindrical, the minimum thickness t may be located at a position that is offset from the trough 304, and/or the maximum thickness T may be located at a position that is offset from the peak 302.

Further, a line bisecting the rotor 202 proceeds twice through the thickness of the shell 212 and once through the core 210. The core 210 and shell 212 may be configured such that, for any such line, a maximum of between about 40% and about 60% (e.g., maximum of about 50%) of its length extends through the material of the shell 212, with the remaining portion extending through the core 210. Stated otherwise, the maximum thickness T of the shell 212 may be, at most between about 20% and about 30% (e.g., about 25%) of the maximum cross-sectional dimension of the rotor 202, since the maximum thickness T of the shell 212 may be traversed twice by a single line bisecting the rotor 202.

The shell 212 may be cast or molded (e.g., injection molded) directly onto and around the core 210. For example, a mold having substantially the desired shape of the shell 212 may be positioned around the core 210, and material for the shell 212 may be injected or otherwise introduced (e.g., in a melted, generally liquid form) therein. Once the material has hardened, the shell 212 may be formed on the core 210. In another embodiment, a mold or cast may be configured to form a cylindrical (or another shape) blank for the shell 212 and may be positioned around the core 210. The material for the shell 212 may be introduced between the mold/cast and the core 210, and hardened. A machining operation may then be applied to cut the shell 212 into a desired shape (e.g., helical with the lobes 214 and cavities 216). In some embodiments, the blank that is formed by the introduction of molten material into the mold/cast may not be cylindrical, but may be helical, or otherwise a "rough" shape for the shell 212, with the machining process then being applied to the formed shell 212 to produce its final shape. In other embodiments, the shell 212 may be three-dimensional (3D) printed onto the core 210. In some embodiments, the 3D printed shell may be machined for a desired finish or shape, but in other embodiments, may not be machined after printing.

In some embodiments, torque-transmitting or "gripping" features between the shell 212 and the core 210 may be provided. In the illustrated embodiment, tabs 217A and 217B are provided as an example of such gripping features. The tabs 217A, 217B extend radially outwards from the core 210 and into the shell 212. While the tabs 217A, 217B are shown as diametrically opposed, this is merely an example, and they may be positioned in any suitable location. Further, the tabs 217A, 217B (or any other gripping features) may be sized and/or positioned so as to avoid impacting conformity with the prescribed minimum thickness t and/or prescribed maximum thickness T for the shell 212, as discussed above. The tabs 217 or other torque-transmitting features may extend a tab distance 218 from the surface of the core 210. For example, the tab distance 218 may be between 10% to 150%, 25% to 100%, or 50% to 75% of the minimum thickness t of the shell 212. In some embodiments, the tabs 217A, 217B may be offset from the peaks of the shell 212, thereby providing circumferential support for the shell 212. Moreover, the rotor 202 may include more than two torque-transmitting features or tabs. In some embodiments, the quantity of torque-transmitting features may correspond to the number of lobes of the shell 212. For example, a rotor 202 having four lobes on the shell 212 may include a core 210 having four torque-transmitting features. In some embodiments, the quantity of torque-transmitting features may exceed the number of lobes of the shell 212.

In other embodiments, the torque-transmitting features may include ridges and/or grooves formed (e.g., axially) along the outer diameter surface of the core 210. In still other embodiments, knurling or any other suitable structures may be provided as part of the torque-transmitting features. It may be appreciated that torque-transmitting features such as ridges, grooves, and knurling may extend from or into the surface of the core 210 less than the tab distance 218 of the tabs 217A, 217B discussed above.

When cast or molded onto the core 210, the inner surface of the shell 212 may form around the tabs 217A, 217B, or otherwise form a structure (e.g., ridges 220 as shown in FIG. 3B, grooves as shown in FIG. 3A, reverse knurling) that is complementary to the gripping features provided by the core 210. As such, the gripping features may provide a radially-extending, circumferentially-facing load-transmitting interface between the shell 212 and the core 210, which may be generally perpendicular to a torque force directed generally tangent to the core 210. The geometry of the torque-transmitting features may be rectangular-shaped, triangular-shaped, or dome-shaped, among other geometries. The torque-transmitting features may be arranged about the core 210 with a leading surface ($S_L$) that is larger than a trailing surface ($S_T$), wherein the leading surface and trailing surface are with respect to rotation of the shell and wherein the leading surface is configured to receive more torque from the shell 210 than the trailing surface when the rotor 202 rotates within the stator 204.

During operation, pressurized fluid (e.g., drilling mud) is forced into the bore 205 (FIG. 2), between the rotor 202 and the stator 204. The geometry of the complementary lobes 209, 214 and cavities 211, 216 of the rotor 202 and the stator 204 converts some of the potential energy stored as pressure into kinetic energy in the form of rotation of rotor 202 via torque force on the outside of the rotor 202, i.e., the shell 212. This torque force is transmitted to the core 210 by engagement with the shell 212. The gripping features (e.g., the tabs 217A, 217B) may thus serve to prevent relative movement of the shell 212 over the core 210 ("slippage") by providing the aforementioned perpendicular interface, thereby avoiding reliance solely on friction between shell 212 and the core 210. Moreover, the shell 212 and core 210 may have unequal coefficients of thermal expansion, since they may be made from different materials. Thus, the gripping features, by extending radially, may provide torque transmission even when the shell 212 has expanded partially away from tight engagement around the core 210.

In some embodiments, the core 210 and/or shell 212 may provide other gripping features, e.g., shoulders or recesses in/on the core 210, which may serve to prevent the shell 212 from slipping axially with respect to the core 210. In some embodiments, the shape of the core 210 itself may be configured to provide torque support for the shell 212.

It will be appreciated that forming the shell 212 from a material such as plastic may reduce the lifecycle of the rotor 202 in comparison to all-metal rotors. Such all-metal rotors may be expensive to manufacture, however, as they may be made from corrosion-resistant materials. That is, if the outer surface thereof of a corrosion-resistant all-metal rotor is damaged, the entire rotor may be replaced. Moreover, since the stator 204 is at least partially made from rubber, the stator 204 may provide an upper bound for the lifecycle of the mud motor 200, and thus reducing the lifecycle of the rotor 202 may have no or little impact on the overall lifecycle of the mud motor 200. For example, the rotor 202 and the stator 204 may be configured to be switched out after approximately the same amount of time in operation, rather than an all-metal rotor outlasting the stator.

FIG. 4 illustrates a flowchart of a method 400 for manufacturing a mud motor, e.g., specifically a rotor of the mud motor, according to an embodiment. Execution of the method 400 may result in one or more embodiments of the mud motor 200 discussed above, and thus the method 400 is described herein with reference thereto. However, execution of other embodiments of the method 400 may result in other mud motors. Furthermore, although the worksteps of the method 400 are provided in a specific order, it will be appreciated that the order may be rearranged and/or the worksteps may be combined, separated, performed in parallel, etc.

The method 400 includes forming a core 210, as at 402. The core 210 may be cast, forged, sintered, or otherwise formed from a metal, e.g., a steel alloy. The core 210 may have a first outer shape, e.g., a cylinder or helix. In at least one embodiment, one or more torque-transmitting features may be formed in or on the core 210, as at 404. For example, one or more ridges and/or one or more grooves may be formed along the length of the core 210.

The method 400 may include forming (e.g., molding or casting) a shell 212 around the core 210, as at 406. For example, the core 210 may be received into a mold, and a material (e.g., molten plastic) may be introduced (e.g., injected) into the mold or cast. The material may be allowed to solidify, cure, or otherwise harden. The mold or cast may then be removed, leaving the shell 212 formed around the core 210.

In some embodiments, the method 400 may further include machining the shell 212, as at 408. For example, in the molding/casting process discussed above, the mold/cast may provide a blank or basic shape for the shell 212. The shell 212 may then be machined at 408 to form the final outer shape for the shell 212. In other embodiments, the casting/molding process may be sufficient to create a desired outer shape for the shell 212, and the machining at 408 may be omitted. Accordingly, either by casting/molding or both by casting/molding and machining (or any other suitable forming technique), the shell 212 may have an outer shape that is different from the first outer shape of the core 210. For example, the shell 212 may define one or more lobes 214 and one or more cavities 216, which are not found in the first outer shape of the core 210.

In some embodiments, a coating, e.g., a low-friction coating, may be applied to the shell 212, as at 410. The coating may follow the contour of the second shape of the shell 212, although some variations in thickness of the coating may be apparent.

In some embodiments, the shell 212 and the core 210 may provide at least a portion of the rotor 202, and thus assembly of the mud motor 200 may include positioning the shell 212 and the core 210 within the stator 204, as at 412. Accordingly, the shell 212 may be configured to engage the bore of the stator 204, which may be provided with lobes and/or cavities that cooperate with the lobes 209 and cavities 211 of the shell 212. As such, whether coated or uncoated, the shell 212 may be configured to engage the stator 204.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A method for manufacturing a rotor for a mud motor, the method comprising forming a shell around a core, wherein:

the shell has a different outer shape than the core, the core having a core feature arranged about the core, the core feature comprising a radially-extending ridge, wherein the radially-extending ridge comprises a circumferentially-facing leading surface and a circumferentially-facing trailing surface with respect to a direction of rotation of the shell positioned around the core, the leading surface being larger than the trailing surface, wherein the leading surface is configured to receive more torque from the shell than the trailing surface;

the shell defines one or more lobes and one or more cavities, the one or more lobes and the one or more cavities being configured to engage a bore of a stator of the mud motor during rotation of the rotor with respect to the stator; and a thickness of the shell varies as proceeding around the rotor, from a non-zero minimum thickness to a maximum thickness.

2. The method of claim 1, wherein forming the shell around the core comprises:

positioning the core at least partially in a mold or cast;

introducing a material into the mold or cast;

hardening the material in the mold or cast to form the shell directly onto and around the core; and removing the mold or cast, such that the shell remains around the core.

3. The method of claim 2, further comprising machining the shell after removing the mold or cast to form the outer shape of the shell.

4. The method of claim 1, further comprising forming one or more torque-transmitting features on the core, wherein the one or more torque-transmitting features are configured to prevent rotation of the shell relative to the core.

5. The method of claim 1, further comprising applying a friction-reducing coating to the shell.

6. The method of claim 1, wherein the core comprises metal, and wherein the shell comprises a composite material, a plastic, or a combination of the plastic and the composite material.

7. The method of claim 1, wherein the shell has a lower strength than the core, a lower melting point than the core, and a different coefficient of thermal expansion than the core.

* * * * *